United States Patent [19]

Schulze

[11] Patent Number: 4,613,074

[45] Date of Patent: Sep. 23, 1986

[54] PROCESS FOR CONTROLLING A HIGH-PRESSURE CLEANER AND HIGH-PRESSURE CLEANER FOR IMPLEMENTING SAID PROCESS

[75] Inventor: Werner Schulze, Winnenden, Fed. Rep. of Germany

[73] Assignee: Alfred Kärcher GmbH & Co., Winnenden, Fed. Rep. of Germany

[21] Appl. No.: 592,405

[22] Filed: Mar. 22, 1984

[30] Foreign Application Priority Data

Mar. 29, 1983 [DE] Fed. Rep. of Germany ..... 3311382

[51] Int. Cl.[4] ..... B08B 3/02

[52] U.S. Cl. ..... 239/1; 137/12; 137/557; 239/8; 239/68; 239/70; 239/444; 417/12; 417/43

[58] Field of Search ..... 239/1, 8, 10, 135, 67, 239/68, 70, 436, 443, 444, 446, 526; 137/7, 12, 240, 552.7, 557, 624.11, 862; 134/18, 42, 56 R, 57 R, 58 R, 113; 73/700, 714, 744, 745, 756; 417/12, 43

[56] References Cited

U.S. PATENT DOCUMENTS

| | | | |
|---|---|---|---|
| 3,246,845 | 4/1966 | Techler et al. | 239/526 |
| 3,485,176 | 12/1969 | Telford et al. | 239/135 |
| 4,109.512 | 8/1978 | Ledeen et al. | 137/12 |
| 4,282,757 | 8/1981 | Cohn | 73/714 |

FOREIGN PATENT DOCUMENTS

| | | |
|---|---|---|
| 2724283 | 11/1978 | Fed. Rep. of Germany . |
| 2746037 | 1/1980 | Fed. Rep. of Germany . |
| 3124944 | 1/1983 | Fed. Rep. of Germany . |

*Primary Examiner*—Andres Kashnikow
*Attorney, Agent, or Firm*—Kenway & Jenney

[57] ABSTRACT

In a high-pressure cleaner, in order to control additional equipment, such as chemical doser or burner, from a hand spray gun without any special control lines, it is proposed to connect a second closable flow path in parallel with the normal flow path through the spray nozzle, to determine the pressure rise time in the cleaning fluid after the switching on of the high-pressure pump and to generate a control signal by opening the second flow path to extend said rise time compared with the rise time when the second flow path is closed; furthermore, a high-pressure cleaner is proposed for implementing this process.

14 Claims, 2 Drawing Figures

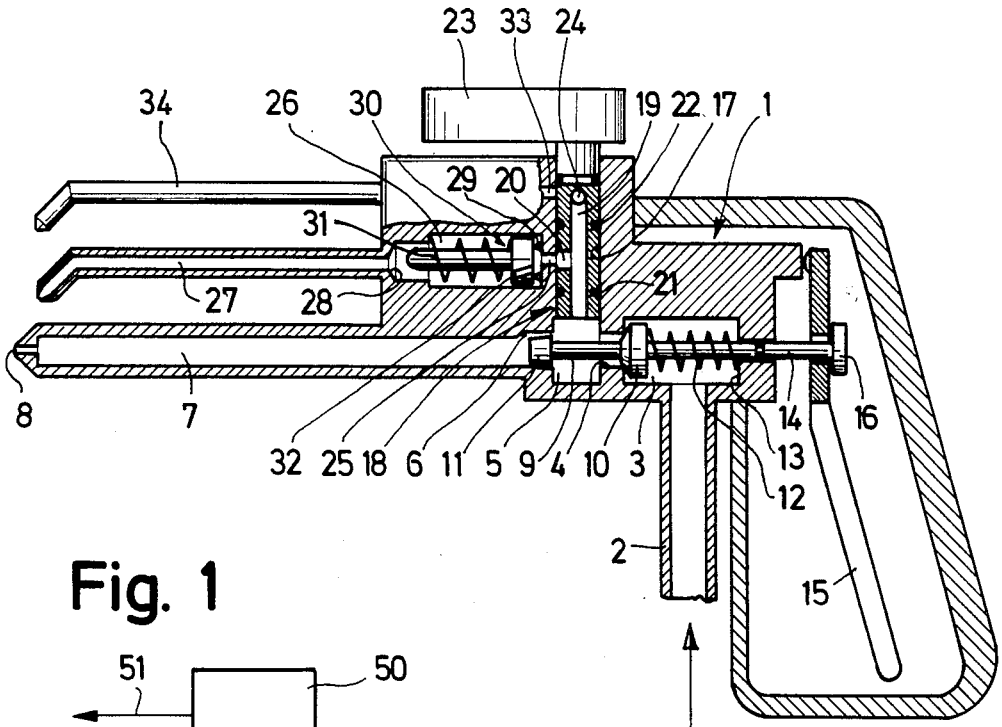
Fig. 1
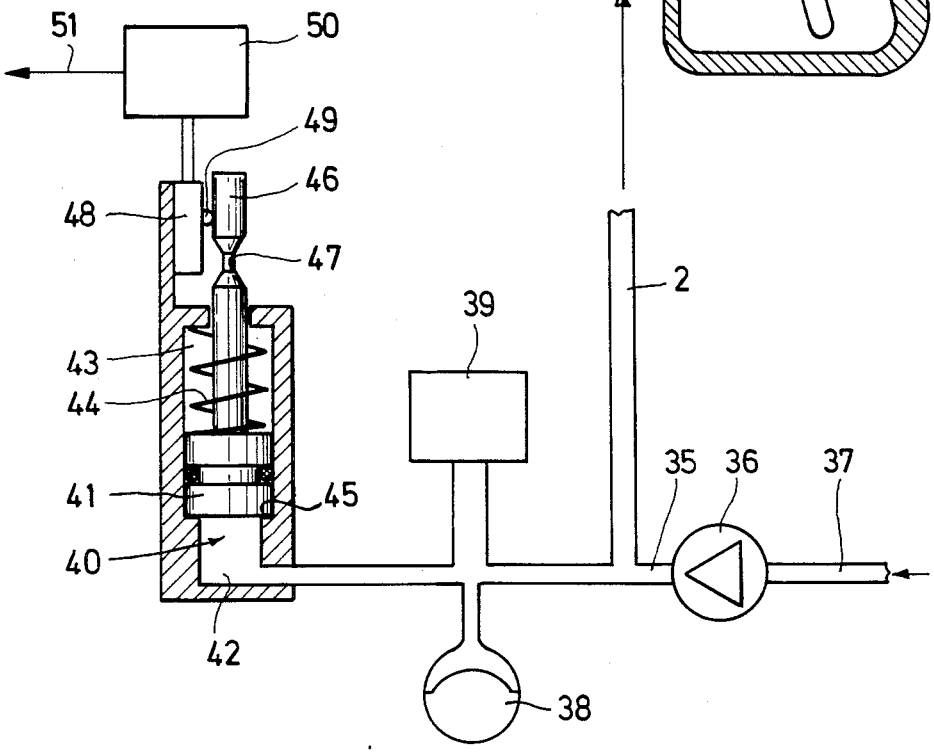

PROCESS FOR CONTROLLING A HIGH-PRESSURE CLEANER AND HIGH-PRESSURE CLEANER FOR IMPLEMENTING SAID PROCESS

The invention relates to a process for controlling a high-pressure cleaner which discharges cleaning fluid through a spray nozzle, said cleaning fluid being delivered by a high-pressure pump through a high-pressure line provided with a closing valve, in which the high-pressure pump is switched on and off as a function of the pressure in the high-pressure line, whereby the pump is switched on when the pressure in the high-pressure line has fallen below the switch-on pressure, said switch-on pressure being below the operating pressure resulting when the high-pressure pump is in operation and the closing valve is wholly or partially open.

The invention also relates to a high-pressure cleaner for implementing said process with a high-pressure pump, a high-pressure line with closing valve leading from said high-pressure pump to a nozzle pipe with a pressure sensor disposed upstream of the closing valve and generating a signal which switches on the high-pressure pump when the pressure drops below the switch-on pressure.

High-pressure cleaners of this type usually also comprise a heat exchanger with a burner as well as a chemical doser so that the discharged cleaning fluid can, as desired, be heated and/or be provided with chemical. In such high-pressure cleaners the optional switching-on of the heating and/or of the chemical dosing should be possible from the hand spray gun which also contains a closing valve or dosing valve for the discharged cleaning fluid. Since the heat exchanger and the chemical doser are usually disposed in the high-pressure cleaner itself which is connected to the hand spray gun by means of a frequently very long high-pressure hose, special signal transmitting means must be provided for the transmission of control signals for the burner and/or the chemical doser. Thus, for example, it is known to have a high-frequency transmitter in the hand spray gun and a corresponding receiver in the high-pressure cleaner with the result that signals reach the transmitter either by wireless means or through armouring surrounding the high-pressure hose. In other designs it is known to embed control lines in the jacket of the high-pressure line. These control lines are used for the transmission of electrical control signals. Such designs are elaborate and susceptible to trouble.

It is also known to control the dosing of chemicals through the pressure of the cleaning fluid itself. Use is made in this connection of a varying throttling action of the spray nozzle in the high-pressure line in order to build up varying pressures in the high-pressure line; at certain pressures of the cleaning fluid, cleaning chemical is added.

However, this design restricts the user in that at a certain pressure corresponding, for example, to a specific nozzle configuration, chemical is always added, and at another pressure this can never happen.

The object of the invention is to disclose a process and a high-pressure cleaner with which, without additional transmission means, burner and/or chemical doser in the high-pressure cleaner can be controlled from the hand spray gun without the user being restricted as regards the discharged quantity of cleaning fluid or the operating pressure.

The object of the invention is achieved by a process of the initially described type in that to generate a control signal, a second, closable flow path is connected in parallel with the flow path through the spray nozzle, whereby, after the switching on of the pump, the pressure rise time in the cleaning fluid is determined and a control signal is generated by opening the second flow path to extend said rise time in comparison with the rise time with the second flow path closed.

If the high-pressure pump is switched on with the high-pressure line open, a certain time elapses until the normal operating pressure has built up in the cleaning fluid in the high-pressure line. For example, this pressure buildup usually requires 0.3 seconds.

This pressure rise time is extended by the use of a second flow path through which high-pressure fluid can escape parallel to the spray nozzle. This extension of the pressure rise time can be determined and used to generate a control signal which, for example, is only generated when there is a specific extension of the pressure rise time. For example, this control signal can be used to switch on the chemical doser or the burner.

The occurrence of the control signal can be determined in simple manner by the operator in that the second flow path is opened or closed, as desired, before the high-pressure pump is switched on.

It is favourable if the second flow path is closed no later than when the operating pressure is reached, so that in normal operation no cleaning fluid escapes through the second flow path.

The object of the invention is achieved by a high-pressure cleaner of the initially described type in that a second, closable flow path is provided parallel with a first flow path leading from the high-pressure line to the nozzle pipe, whereby connected to the high-pressure line is a pressure-sensitive signal generator which is connected to a timer, said timer generating a control signal when the rise time between two specific pressure values exceeds a certain value when the high-pressure pump switches on.

In a preferred embodiment the pressure-sensitive signal generator may comprise two pressure sensors which each supply a signal to the timer at different pressures. The timer may in known manner check the time between these two signals and compare it with a given time difference so that a control signal is generated when the given time difference value is exceeded.

It is also possible for the pressure-sensitive signal generator to comprise a switching element which can be displaced by the cleaning fluid against the action of a flexible stored-energy means whereby, in various positions, said switching element actuates switches connected to the timer. It is adavantageous if the switching element is assigned one single switch which is actuated by the switching element when a pressure value is reached and is released again when a second pressure value is reached. In this case, therefore, the timer is supplied with a switch closing signal and, after a certain time, with a switch opening signal, the interval between the signals being able to be determined in the same manner as the consecutive signals from two pressure sensors or two consecutively actuated switches.

Preferably, there is a manually actuated closing valve for the second flow path which can easily be controlled by the operator and which tells the operator the condition of the closing valve in the second flow path.

In a preferred embodiment, situated in the second flow path is a valve body which can be displaced in the flow direction against a seat against the action of a flexible stored-energy means and which can be displaced by the cleaning fluid against the seat to form a seal no later than when the operating pressure is reached, with the result that the second flow path is closed. This automatically guarantees that the second flow path is closed when the operating pressure is reached and that the cleaning fluid is discharged entirely through the first flow path.

It is particularly advantageous if, when at rest, the valve body is forced by the flexible stored-energy means against an upstream valve seat, thereby closing the second flow path, whereby, after lifting off said valve seat, the valve body forms a throttling body in the second flow path. In this way, even with the closing valve open, the second flow path only opens when a certain minimum pressure is reached, and closes again as soon as a maximum pressure is exceeded.

In a preferred embodiment, further parallel flow paths can be connected to the first and second flow paths whereby for different extensions of the pressure rise time compared with the pressure rise time resulting when only the first flow path is open, the timer generates different control signals. Several flow paths make it possible to produce graduated pressure rise times which can be used to generate several control signals, for example for generating a control signal for switching on the burner and a second control signal for switching on the chemical doser.

The invention is described in greater detail below with reference to the drawings in conjunction with preferred embodiments.

FIG. 1 shows a diagrammatic sectional view of a hand spray gun and essential parts of the high-pressure system in a high-pressure cleaner.

Figure 2:
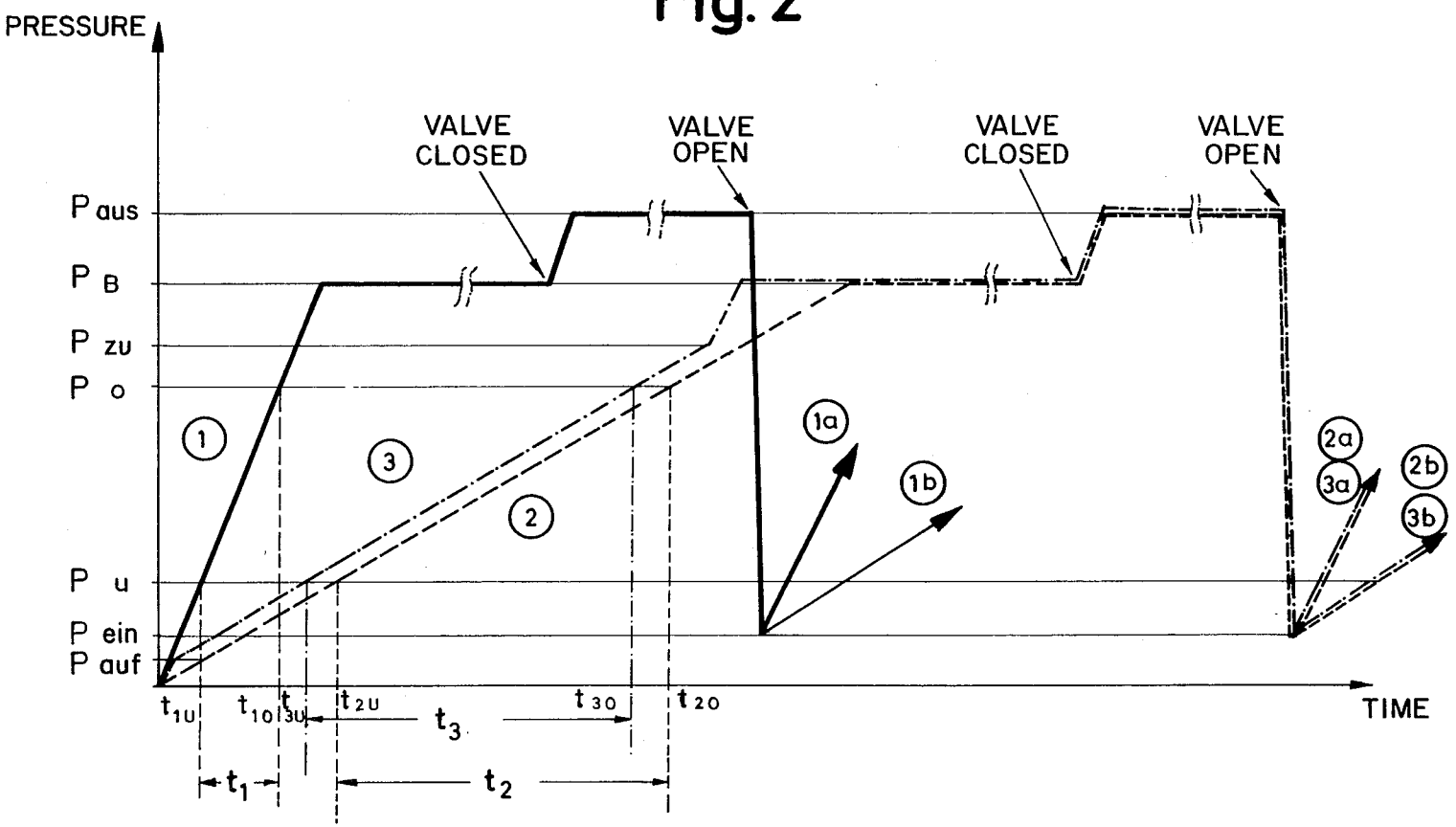
FIG. 2 shows a diagrammatic representation of the pressure variations in the cleaning fluid as a function of time.

A gun-shaped handpiece 1 is connected to a flexible high-pressure line 2 which joins into a cavity 3 in the handpiece 1. The cavity 3 is connected by means of an opening 4, a branch chamber 5 and a throttling point 6 to a spray line 7 which joins into the atmosphere by means of a spray nozzle 8. An actuating rod 9 penetrates the cavity 3 in the longitudinal direction and makes a sealed exit from said cavity. Held on this actuating rod 9 inside the cavity 3 are a closing body 10 and, at the free end of the actuating rod 9 in the region of the throttling point 6, a throttling body 11. A compression spring 12 surrounds the actuating rod 9 inside the cavity 3 and is supported on one side on the closing body 10 and on the other side on the opposite wall 13 of the cavity 3 so that the closing body (10) is pressed by the compression spring 12 against the opening 4 and closes the latter. In this position, the throttling body 11 penetrates over its entire length into the area of the spray line 7 which is termed at the top as the throttling point 6. This is shown in FIG. 1. With its end 14 opposite the throttling body 11 the actuating rod penetrates an actuating lever 15 which is swivel-mounted on the handpiece 1; the end projecting beyond the actuating lever 15 bears a widened section 16. When the lever 15 is pivoted, the actuating rod 9 can be displaced against the action of the compression spring 12 so that, firstly, the closing body 10 lifts off the opening 4 and opens the latter while, secondly, the penetration depth of the throttling body 11 into the throttling point 6 is reduced. As a result, firstly, the high-pressure line is opened and, secondly, by gradual pivoting of the actuating lever 15 it is possible to dose the quantity of cleaning fluid which is allowed to pass the throttling point 6.

Rotatably mounted in a duct 17 extending perpendicular to the branch chamber 5 is a valve body 18 which exhibits a central longitudinal blind hole 19 which is connected to the branch chamber 5. Emerging from this blind hole in the radial direction of the valve body 18 is a branch line 20 which extends as far as the circumference of the valve body 18. On either side of the branch line 20 the valve body is sealed from the inside wall of the duct 17 by inserted seals 21 and 22.

Above the branch line 20 there is a further radial branch line 24 which is offset at an angle from the first branch line 20 in the circumferential direction.

By means of a handle 23 projecting from the handpiece 1 the valve body 18 in the duct 17 can be turned to various positions which are explained below.

At the level of the first branch line 20 a connecting line 25 joins into the duct 17 and connects the duct 17 to a valve chamber 26. This valve chamber 26 is connected on the opposite side to an outlet line 27 which joins into the atmosphere. A valve seat 28 is disposed in the region of the transition from the valve chamber 26 into the outlet line 27; inside the valve chamber 26 the connecting line 25 is likewise surrounded by an annular valve seat 29. Situated inside the valve chamber 26 is a valve body 30 in the form of a stepped piston which has a large diameter at its end facing the valve seat 29, and a smaller diameter at the opposite end. In this region the valve body 30 is surrounded by a compression spring 31 which is supported on one side of the inside wall of the valve chamber 26 and on the other side of the valve body 30 itself, thus forcing the valve body 30 against the valve seat 29, as can be seen from FIG. 1. The valve body 30 can be displaced against the force of the compression spring 31 toward the outlet line 27, so that it finally closes the latter. The part of the valve body adjacent to the valve seat 29 forms a throttle in the cylindrical valve chamber 26. For this purpose, the piston whose outside diameter is approximately the same as the inside diameter of the valve chamber 26 has a circumferential groove 32 of small cross section. In an alternative design, the outside diameter of the valve body 30 may be slightly smaller than the inside diameter of the valve chamber 26, so that there results between valve body 30 and valve chamber 26 an annular gap which acts as throttling point.

By suitable turning of the valve body 18, the branch line 20 in the valve body 18 can be connected to the connecting line 25 and thus via the valve chamber to the outlet line 27.

In the same manner, the second branch line 24 is assigned a corresponding connecting line 33 which is likewise connected to an outlet line 34 by way of a valve chamber which is not shown in the drawing. As in the valve chamber 26, the valve chamber assigned to the branch line 24 contains a valve body which is of the same construction as the valve body 30.

Therefore, by appropriate turning of the valve body 18 in the duct 17 it is possible to connect the branch chamber 5 either via the first branch line 20 to the first outlet line 27 or via the second branch line 24 to the second outlet line 34, or to close all connections of the branch chamber with any of the outlet lines.

The high-pressure line 2 is connected to the pressure outlet 35 of a high-pressure pump 36 to which the cleaning fluid which is to be sprayed is supplied from a suction line 37. The high-pressure line 2 is also connected to a pressure equalisation vessel 38 as well as to a pressure switch 39 which is shown only schematically in the drawing and by means of which the high-pressure pump 36 can be switched on and off.

Finally, the high-pressure line 2 is connected to the interior of a chamber 40 which is divided into two sub-chambers 42 and 43 by means of a piston 41 which is sealingly displaceable in said chamber 40. The high-pressure line 2 joins into the first sub-chamber 42 while in the second sub-chamber there is a compression spring 44 which is supported on one side on the piston 41 and on the other on the inside wall of the chamber 40, and presses the piston 41 against a step 45 in the first sub-chamber 42.

An actuating rod 46 connected to the piston projects out of the second sub-chamber 43 and bears a throat 47. Adjacent to the projecting end of the actuating rod 46 is a switch 48 which is actuated by the actuating rod 46 but which is released when the throat 47 is next to a switching element 49 of the switch. The switch 48 is connnected to a timer 50 which is shown only in diagrammatic form in the drawing. This timer 50 receives switch-on/switch-off signals from the switch as the piston is displaced and determines the interval between these signals. This interval is compared with a fixed value, and if the interval exceeds a certain value, the timer 50 generates a control signal which is supplied via a control line 51, for example, to a chemical doser (not shown in the drawing) or to the burnner of a heater of the high-pressure cleaner.

The operating principle of the described cleaner is explained in the following with reference to FIG. 2 which shows the pressure versus time for various operating states. For the sake of simplification, all curves are shown as being rectilinear and not to scale.

Firstly, with reference to the solid-line curve identified by 1 in FIG. 2, there is a discussion of normal operation in which the branch chamber 5 is connected neither to the outlet line 27 nor to the outlet line 34. If, with the opening 4 open, the high-pressure pump is switched on, a pressure builds up in the high-pressure line due to the throttling action of the spray nozzle 8. In the following, this pressure is referred to as operating pressure $p_B$. This pressure of the cleaning fluid in the high-pressure line is maintained as long as the opening 4 is open. This presure depends slightly on the variable throttling action in the throttling point 6, but for reasons of simplification, it is assumed in the following that the operating pressure $p_B$ is constant.

As the pressure rises to operating pressure, the piston 41 in the chamber 40 is displaced by the cleaning fluid against the force of the spring 44. The dimensioning is such that as the pressure rises to a lower limit value $p_u$ the initially actuated switch is released since the switching element 49 comes into the region of the throat 47. As soon as an upper limit value of the pressure $p_o$ is reached, the switch 48 is actuated again by the actuating rod 46. Consequently, the timer 50 is supplied with two signals as the pressure rises, namely at time $t_{1u}$ with a signal corresponding to the lower limit value $p_u$ and at at time $t_{10}$ with a signal corresponding to the upper limit value $p_o$. Using known electronic means, the time $t_1$ between $t_{1u}$ and $t_{10}$ is determined in the timer 50, i.e. the timer determines the pressure rise time $t_1$ between the lower limit value $p_u$ and the upper limit value $p_o$.

The timer compares this pressure rise time $t_1$ with a setpoint which is selected such that it is greater than $t_1$. If the pressure rise time is smaller than the setpoint, the timer 50 does not generate a control signal for the chemical doser and/or for switching on the burner.

In the course of further operation the operating pressure $p_B$ is maintained as long as the hand lever 15 is actuated. If the operator releases the hand lever 15, the opening 4 is closed with the result that a higher pressure builds up in the high-pressure line 2. As soon as this pressure exceeds a value $p_{aus}$, the pressure switch 39 responds and switches the high-pressure pump 36 off. Since the high-pressure line 2 is closed in this operating state, the cleaning fluid remains at pressure $p_{aus}$ whereby the leakage losses which occur in reality have been intentionally neglected here.

If the operator again opens the opening 4, the pressure drops suddenly. On reaching a pressure $p_{ein}$ the pressure switch 39 generates a switch-on signal for the high-pressure pump, and the pressure rise begins again in the above-described manner; this is shown by curve 1*a* in FIG. 2.

In a second operating mode the value body 18 in the duct 17 is turned by means of the handle 23 so that the branch chamber 5 is connected to the outlet line 27 by means of the longitudinal bore 19 and the branch line 20. The pressure curve in this case is represented by the broken line 2 in FIG. 2.

In this operating mode, therefore, a second flow path is connected parallel to the spray nozzle 8 so that there is a slower pressure rise, i.e. the operating pressure $p_B$ is reached later than in the above-described case of normal operation. The lower limit value $p_u$ is reached at a time $t_{2u}$, and the upper limit value $p_o$ at a time $t_{20}$, with the result that there is a total pressure rise time $t_2$ which is considerably longer than the pressure rise time $t_1$ in normal operation.

The timer 50 compares time $t_2$ with the setpoint time which is selected lower. Since $t_2$ is greater than the setpoint time, the timer 50 generates a control signal which is supplied via the control line 51, for example, to the chemical doser. In this manner, the chemical doser is switched on and adds a chemical to the cleaning fluid.

For curve 2 it is assumed that there is no valve body in the valve chamber 26 with the result that the outlet line 27 remains open even after the operating pressure $p_B$ has been reached. Consequently, although the operating pressure $p_B$ shifts slightly, this shift has been neglected in FIG. 2.

After the operating pressure $p_B$ has been reached, the hand spray gun sprays cleaning fluid (to which a chemical has been added) essentially through the spray nozzle 8; some of this quantity of fluid is discharged through the outlet line 27. If the hand lever 15 is released, the opening 4 is closed again with the result that the pressure in the high-pressure line rises until, when the switch-off pressure $p_{aus}$ is reached, the high-pressure pump is switched off. If the opening 4 is opened again by actuating the hand lever 15, the pressure in the high-pressure line drops steeply until, at a pressure $p_{ein}$, the high-pressure pump is switched on again. The pressure rise now takes place either according to curve 2*a* if the branch chamber 5 has been cut off again by turning the valve body 18 in duct 17, or according to curve 2*b* if the valve body 18 remains unturned.

A slight change in the pressure characteristics results from the above-described presence of the valve body 30 in the valve chamber 26. This is shown by the dash-dotted curve 3 in FIG. 2. Even if the valve body 18 is positioned so that the branch line 20 joins into the valve chamber 26, it is impossible at low pressures at first for any cleaning fluid to enter the valve chamber 26 since the latter is closed by the valve body 30. The valve body 30 is only lifted off the valve seat 29 at an opening pressure $p_{auf}$; i.e. up to this pressure the pressure rise takes place with the same steepness as in the case of normal operation. However, as soon as the valve body 30 has been lifted off the valve seat 29 some of the cleaning fluid can flow through the outlet line 27, i.e. one obtains a pressure rise corresponding to that of curve 2. This applies until the valve body 30 is moved into the valve seat 28, thus closing the outlet line 27. This takes place at a closing pressure $p_{zu}$. As of this pressure there is again a rapid pressure rise as in normal operation until the operating pressure $p_B$ is reached. The pressure rise time $t_3$ between reaching the lower limit value $p_u$ at time $t_{3u}$ and reaching the upper limit value $p_o$ at time $t_{30}$ is basically the same as in the case of curve 2, i.e. it is likewise above the setpoint time with the result that, in this case too, a control signal is generated for the dosing of chemical. However, in this case, it is advantageous for the outlet line 27 to be close just before the operating pressure $p_B$ is reached so that during the following operation the cleaning fluid is discharged exclusively through the spray nozzle 8.

In the same manner it is possible to vary the pressure rise time between the lower limit value $p_u$ and the upper limit value $p_o$ by connecting in the outlet line 34 instead of the outlet line 27, or by connected in both lines 27 and 34 simultaneously. Different rise times can be used to generate different control signals. For example, with a short rise time no control signal is generated, with a medium pressure rise time the dosing of chemicals is switched on, with a longer pressure rise time only the burner of a heater is switched on, and with a particularly long pressure rise time both the dosing of chemical as well as the burner are switched on.

For this purpose, of course, it is possible to provide even more parallel outlet lines whose outlet cross sections are dimensioned for obtaining different pressure rise times.

If the operator wishes to switch from one operating mode to the other, he merely releases the actuating lever 15 in order to close the opening 4. In this position, a new operating mode is selected by actuating the handle 23, and subsequently the opening 4 is opened again by means of the actuating lever 15. It is thus possible to switch from any operating mode to any other operating mode. The switching on of the dosing of chemical and/or of the burner by a control signal can be cancelled, for example, by a further control signal which leads to the switching off of the high-pressure pump when the switch-off pressure $p_{aus}$ is reached.

In the following, some numerical values are given for the various pressures—these serve only as an example. Thus, for example, the operating pressure $p_B$ may be 100 bar, the switch-off pressure $p_{aus}$ 110 bar. The switch-on pressure $p_{ein}$ may be 15 bar, the lower limit value $p_u$ 20 bar and the upper limit value $p_o$ 45 bar. The pressure at which the valve body 30 lifts off the valve seat 29 is below the switch-on pressure $p_{ein}$, for example 10 bar, the pressure at which the valve body 30 closes the outlet line 27 between the upper limit value $p_o$ and the operating pressure $p_B$, for example 70 bar.

In practice, the total rise time to reaching the operating pressure in normal operation (curve 1 in FIG. 2) may be, for example, 0.3 seconds, the pressure rise time $t_1$ 0.15 seconds, for example. In the case of a delayed pressure rise, the time to reaching the operating pressure may increase, for example, 0.7 seconds; the times $t_2$ and $t_3$ (curves 2 and 3 respectively) are then, for example, 0.4 seconds.

The determination of the pressure rise time between the limit values $p_u$ and $p_o$ can, of course, also be performed in a different manner, for example by means of a pressure pickup (e.g. piezoelectric crystal, wire strain gauge etc.) which produces pressure-proportional signals, or by means of two separate pressure sensors, one for generating a signal when the lower limit value is reached and one for generating a signal when the upper limit value is reached.

What is claimed is:

1. Process for controlling a high-pressure cleaner which discharges cleaning fluid through a spray nozzle, said cleaning fluid being delivered by a high-pressure pump through a high-pressure line provided with a closing valve, in which the high-pressure pump is switched on and off as a function of the pressure in the high-pressure line, whereby the pump is switched on when the pressure in the high-pressure line has fallen below the switch-on pressure, said switch-on pressure being below the operating pressure resulting when the high-pressure pump is in operation and the closing valve is wholly or partially open, wherein to generate a control signal, a second, closable flow path is connected in parallel with the flow path through the spray nozzle, whereby, after the switching on of the pump, the pressure rise time in the cleaning fluid between a lower limit value $P_u$ and an upper limit value $P_o$ is determined and a control signal is generated by opening the second flow path to extend said rise time in comparison with the rise time with the second flow path closed.

2. Process as defined in claim 1, wherein the second flow path is closed no latter than when the operating pressure is reached.

3. High pressure cleaner with a high pressure pump, a high-pressure line with closing valve leading from said high pressure pump to a nozzle pipe, and with a pressure sensor disposed upstream of the closing valve and generating a signal which switches on the high-pressure pump when the pressure drops below the switch-on pressure, wherein a second, closable flow path (outlet line 27; outlet line 34) leading from the high pressure line (2) to an outlet (27) and serving to change the pressure rise time is provided parallel with a first flow path leading from the high pressure line (2) to the nozzle pipe (7), whereby connected to the high-pressure line (2) is a pressure-sensitive signal generator (48) which is connected to a timer (50), said timer (50) generating a control signal to cause the operation of auxiliary equipment when the rist time (t) between two specific pressure values (lower limit value $p_w$; upper limit value $p_o$) exceeds a certain value when the high-pressure pump (36) switches on.

4. High-pressure cleaner as defined in claim 3, wherein the pressure-sensitive signal generator comprises two pressure sensors which each supply a signal to the timer (50) at different pressures.

5. High-pressure cleaner as defined in claim 3, wherein the pressure-sensitive signal generator comprises a switching element (41, 46) which can be displaced by the cleaning fluid against the action of a flexible, stored-energy means (44), whereby, in various positions, said switching element (41, 46) actuates switches (48) connected to the timer (50).

6. High-pressure cleaner as defined in claim 5, wherein the switching element (41, 46) is assigned one single switch (48) which is actuated by the switching element (41, 46) when a pressure value (lower limit value $p_u$) is reached and is released again when a second pressure value (upper limit value $p_o$) is reached.

7. High-pressure cleaner as defined in claim 3, wherein the control signal switches on a dosing of chemicals into the cleaning fluid.

8. High-pressure cleaner as defined in claim 3, wherein the second flow path branches from the first flow path downstream of the closing valve (opening 4; closing body 10).

9. High-pressure cleaner as defined in claim 8, wherein downstream of the closing valve (opening 4, closing body 10) a dosing valve (dosing point 6; throttling body 11) is disposed in the first flow path (spray line 7), and the second flow path branches upstream of the dosing valve.

10. High-pressure cleaner as defined in claim 3, wherein a manually actuated closing valve (valve body 18) is provided for the second flow path.

11. High-pressure cleaner as defined in claim 3, wherein situated in the second flow path is a valve body (30) which can be displaced in the flow direction against a seat (28) against the action of a flexible stored-energy means (31) and which can be displaced by the cleaning fluid against the seat (28) to form a seal no later than when the operating pressure $p_B$ is reached, with the result that the second flow path is closed.

12. High-pressure cleaner as defined in claim 11, wherein, when at rest, the valve body (30) is forced by the flexible stored-energy means (31) against an upstream valve seat (29), thereby closing the second flow path, whereby, after lifting off said valve seat (29), the valve body (30) forms a throttling body in the second flow path.

13. High-pressure cleaner as defined in claim 3, wherein further parallel flow paths (outlet line 34) can be connected to the first and second flow paths (spray line 7; outlet line 27) whereby for different extensions of the pressure rise time compared with the pressure rise time resulting when only the first flow path (spray line 7) is open, the timer (50) generates different control signals.

14. High pressure cleaner as defined in claim 3 wherein the control signal switches on the burner of a heater.

* * * * *